US005552974A

United States Patent [19]

Tsai

[11] Patent Number: 5,552,974

[45] Date of Patent: Sep. 3, 1996

[54] LIGHT STRING

[76] Inventor: George Tsai, 7F1., No. 147, Sec. 4, Jen-Ai Rd., Taipei, Taiwan

[21] Appl. No.: 297,302

[22] Filed: Aug. 29, 1994

[51] Int. Cl.[6] ..... F21V 21/14

[52] U.S. Cl. ..... 362/250; 362/123; 362/226; 362/252; 362/806

[58] Field of Search ..... 362/123, 249, 362/250, 252, 226, 227, 421, 806

[56] References Cited

U.S. PATENT DOCUMENTS

| | | | |
|---|---|---|---|
| 2,414,866 | 1/1947 | Glaser | 362/123 |
| 3,619,599 | 11/1971 | Hermanson | 362/250 |
| 4,128,863 | 12/1978 | Premetz | 362/249 |
| 4,639,841 | 1/1987 | Salestrom et al. | 362/249 |
| 4,890,206 | 12/1989 | Lee | 362/250 |
| 4,945,279 | 7/1990 | Leu | 362/806 |
| 5,018,055 | 5/1991 | Wu | 362/249 |
| 5,161,882 | 11/1992 | Garrett | 362/249 |

FOREIGN PATENT DOCUMENTS

| | | | |
|---|---|---|---|
| 437494 | 2/1912 | France | 362/250 |
| 213619 | 1/1908 | Germany | 362/250 |
| 137736 | 1/1920 | United Kingdom | 362/252 |

*Primary Examiner*—Denise L. Gromada
*Assistant Examiner*—Alan B. Cariaso
*Attorney, Agent, or Firm*—Poms, Smith, Lande & Rose

[57] ABSTRACT

A Christmas light string includes a chain including a plurality of pairs of first and second plastic links each defining at least one socket-receiving aperture. Each first link includes two protrusions each including a head shaped as an arrow head. Each second link defines two protrusion-receiving apertures. The protrusions are engageable in the plastic links. A plurality of sockets are each insertable in one of the socket-receiving apertures. A plurality of bulbs each include a husk insertable in one of the sockets.

2 Claims, 6 Drawing Sheets

LIGHT STRING

BACKGROUND OF THE INVENTION

This invention relates to a Christmas light string which can be easily retained in various patterns.

Christmas light strings are hung on Christmas trees or buildings for decorative purposes. It is difficult to retain the Christmas light strings in various patterns as they are flexible thus providing limited decorative effect. Therefore, this invention is intended to solve the above-mentioned problem.

SUMMARY OF THE INVENTION

It is the primary object of this invention to provide a Christmas light string which can be easily retained in various patterns.

The primary object of this invention is achieved by providing a Christmas light string including a chain incorporating a plurality of plastic links each defining at least one socket-receiving aperture and a plurality of Christmas bulbs received in the apertures defined in the links. The Christmas light string can be easily retained in various patterns as they links are rigid and connected with each other by appropriate means.

In a first aspect of this invention, each of the links define an aperture near a first end and a protrusion near a second end. The protrusion formed on a link is engageable in the aperture defined in another link thus forming a chain which can be easily retained in various patterns.

In a second aspect of this invention, some of the links each define two apertures near two ends. The remaining links each define two protrusions. A protrusion formed on a first link is engageable in an apertures defined in a second link and the remaining protrusion formed on the first link is engageable in an aperture defined in a third link. A plurality of links can be connected with one another in this way so as to form a chain which can be easily retained in various patterns.

For a better understanding of this invention and objects thereof, a study of the detailed description of the embodiments described hereinafter should be made in relation to the accompanying drawings.

DETAILED DESCRIPTION OF THE PREFERRED EMBODIMENT

Figure 1:
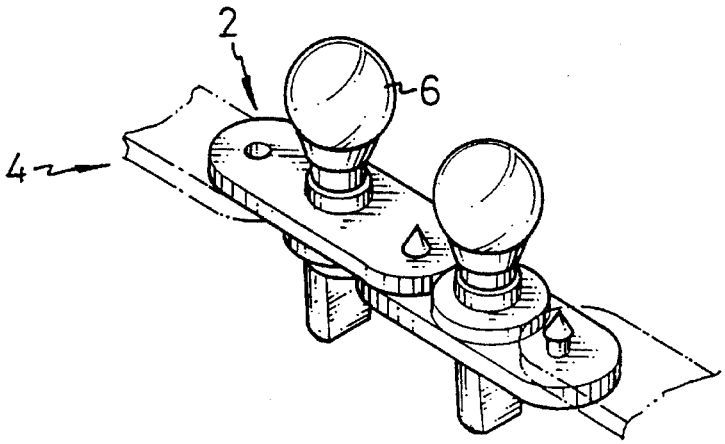
FIG. 1 is an isometric view of a part of a Christmas light string with accordance with a first embodiment of this invention.

FIG. 1 shows a Christmas light string 2 which includes a chain 4 and a plurality of bulbs 6.

Figure 2:
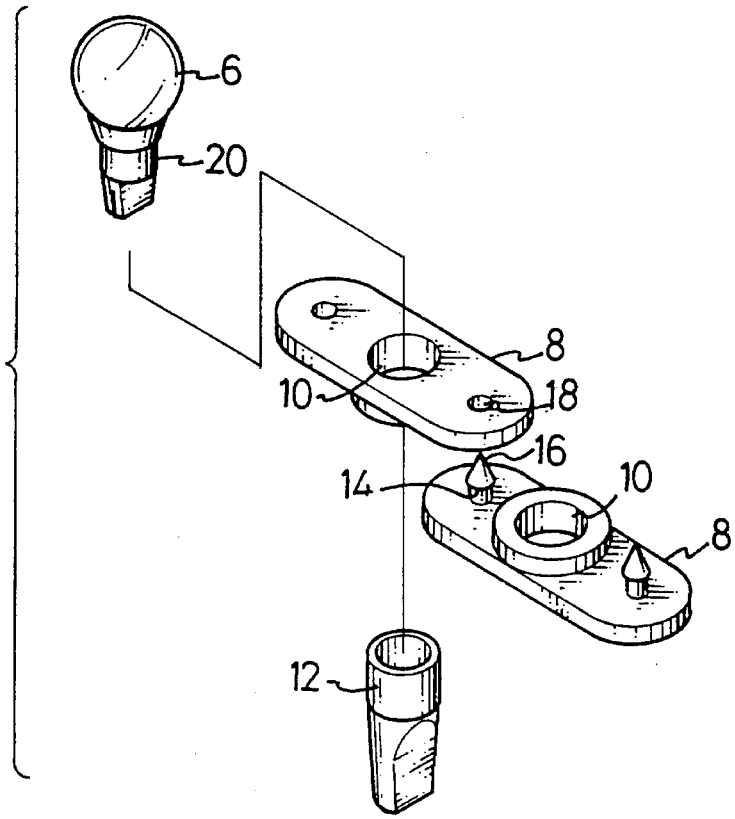
FIG. 2 is an exploded view of a part of a Christmas light string in accordance with the first embodiment of this invention.

Referring to FIG. 2, the chain 4 includes a plurality of plastic links 8 (only two are shown for example) which are connected with one another by appropriate means which will be described later. Theoretically, the length of the chain 4 can be indefinite as the number of the links 8 can be indefinite. Each of the links 8 defines at least one socket-receiving aperture 10.

There are a plurality of sockets 12 each of which is fitted in a corresponding socket-receiving aperture 10. The sockets 12 will not be described in detail as being similar to conventional sockets in regard to structure and function.

FIG. 2 shows two links 8. One of the links 8 includes two protrusions 14 projecting from two points near two ends thereof. Each of the protrusion 14 includes a head 16. In this embodiment, the head 16 is shaped as an arrow head, however, the head can employ any other appropriate configurations. The remaining link 8 defines two protrusion-receiving apertures 18 near two ends thereof. The head 16 of each protrusion 14 can be pressed through a protrusion-receiving aperture 18 in a direction for joining together the plastic links 10 thus forming the chain 4. The links 8 can be disengaged from one another, if so desired, by pulling the heads 16 through the protrusion-receiving apertures 18. The length of each protrusion 14 is equal to the thickness of each link 8 so that each link 8 is forced against another link 8 by means of a protrusion 14. Thus each link 8 can be easily retained in any desired angle relative to another link 8 by a frictional force. Therefore, the chain 4 can be easily retained in any desired pattern.

Figure 3:
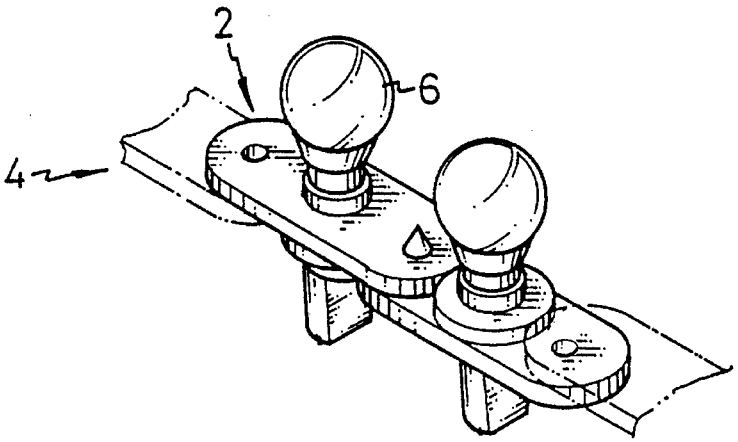
FIG. 3 is a perspective view of a Christmas light string according to a second embodiment of this invention.
Figure 4:
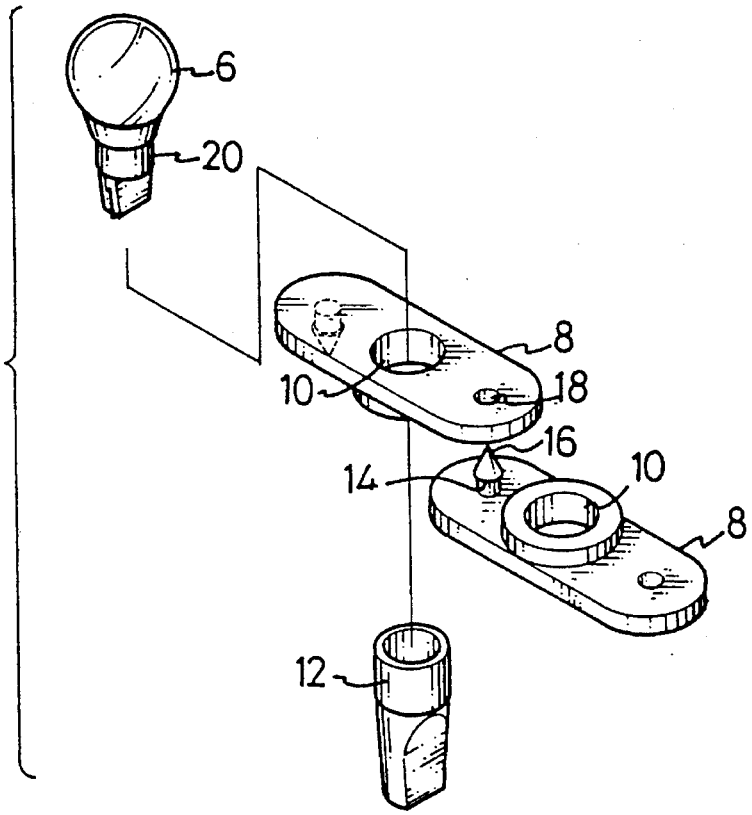
FIG. 4 is an exploded view of a Christmas light string according to the second embodiment of this invention.

FIGS. 3 and 4 show a second embodiment of the chain 4. FIG. 4 shows two links 8. Each of the links 8 includes a protrusion 14 with a head 16 and a protrusion-receiving aperture 18. The head 16 of the protrusion 14 of a link 8 is pressed through the protrusion-receiving aperture 18 defined in the remaining link 8 for joining together the links 8 thus forming the chain 4 shown in FIG. 3. The links 8 can be disengaged from one another, if so desired, by pulling the heads 16 through the protrusion-receiving apertures 18.

Each of the Christmas bulbs 6 includes a husk 20. The husks 20 can be received in the sockets 12 so that the Christmas bulbs 6 are attached to the chain 4.

Figure 5:
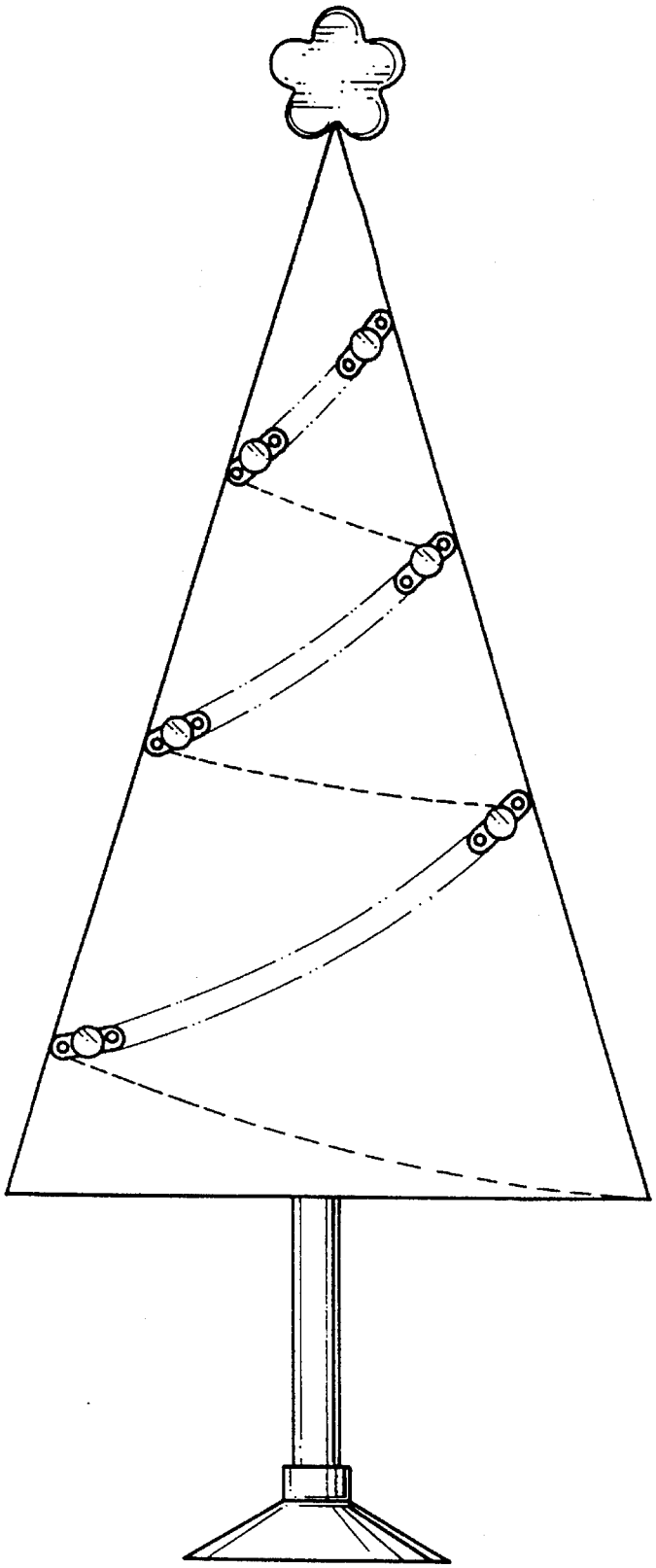
FIG. 5 is a side view of a Christmas tree on which a Christmas light string is hung in a first manner.

FIG. 5 shows a Christmas tree on which a Christmas light string 2 is hung so that the Christmas light string 2 is in a spiral form.

Figure 6:
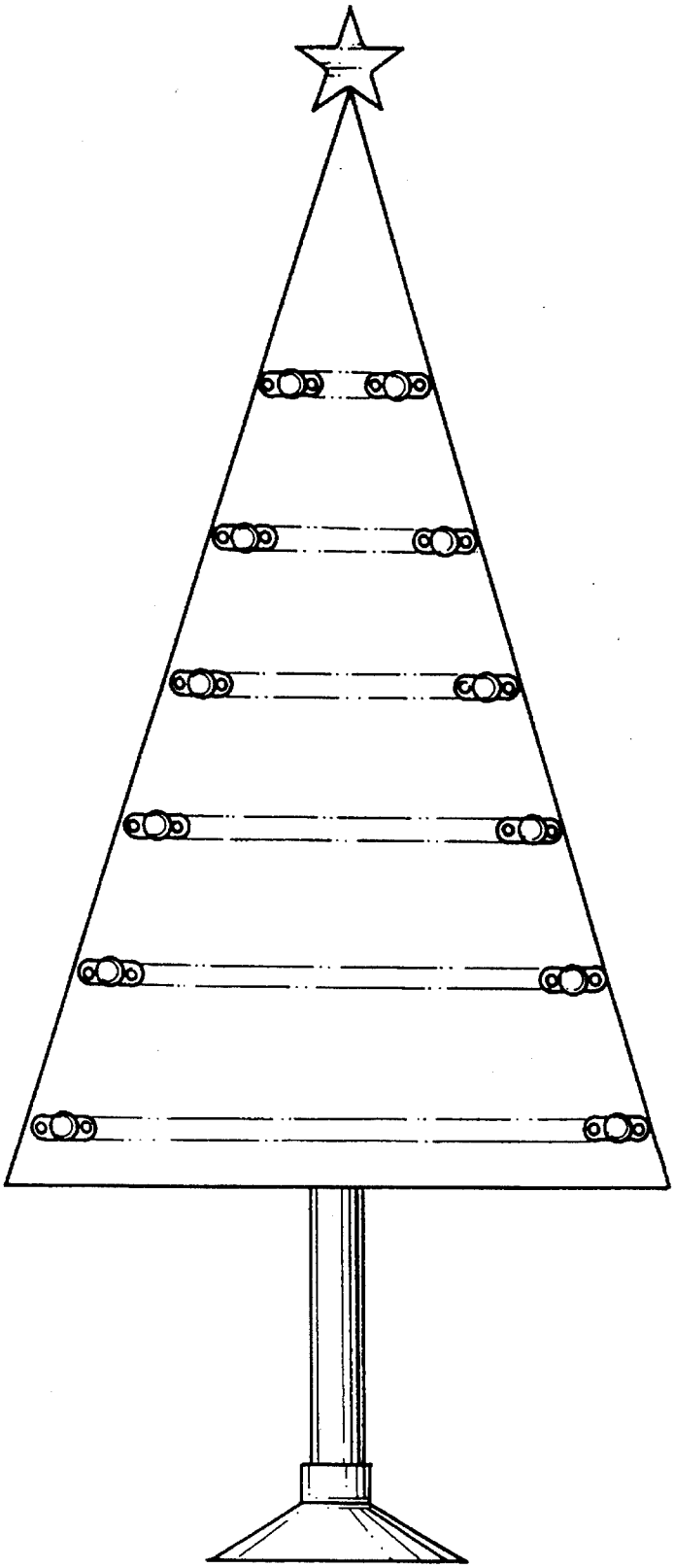
FIG. 6 is a side view of a Christmas tree on which a plurality of Christmas light strings are hung in a second manner.

FIG. 6 shows a Christmas tree on which a plurality of Christmas light strings 2 are hung so that each of the Christmas light strings 2 is arranged as a loop.

Figure 7:
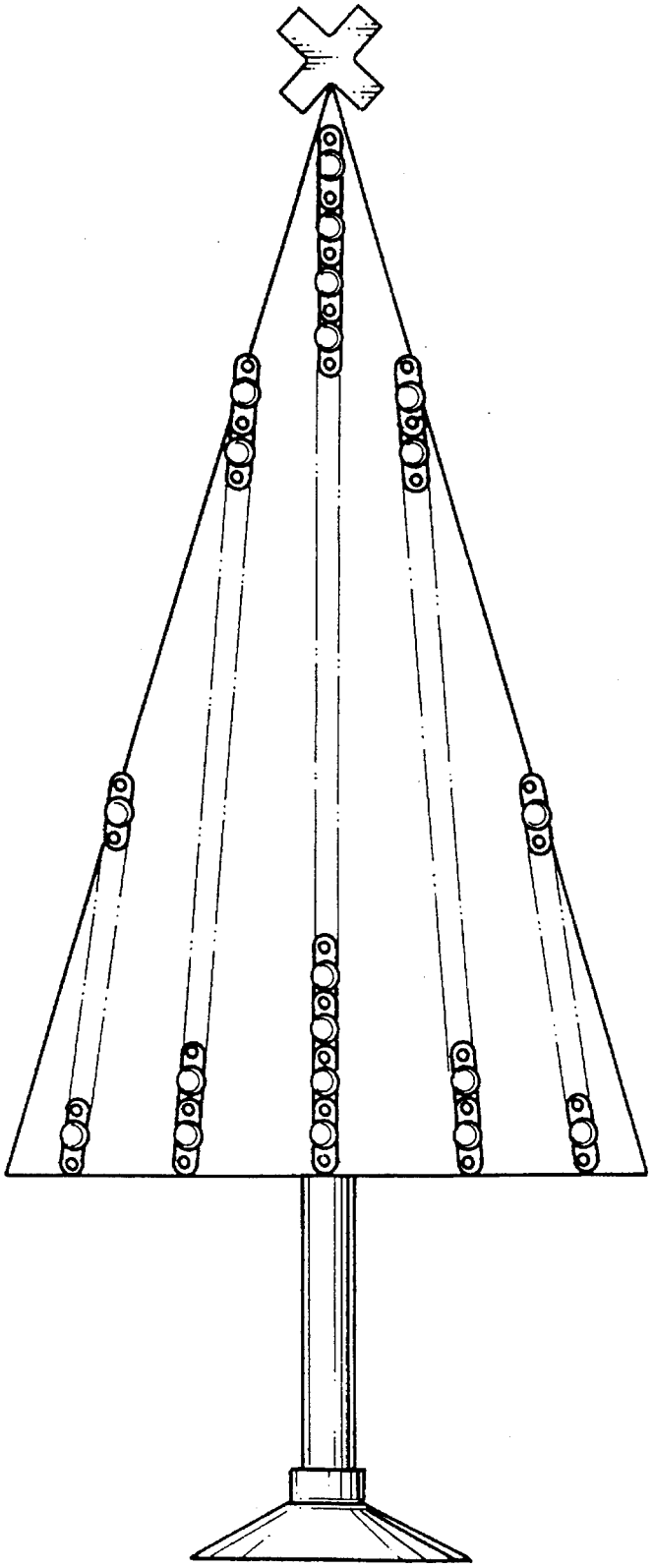
FIG. 7 is a side view of a Christmas tree on which a plurality of Christmas light strings are hung in a third manner.

FIG. 7 shows a Christmas tree on which a plurality of Christmas light strings 2 are hung in a third manner so that each of the Christmas light strings 2 is arranged along an inclined line.

Figure 8:
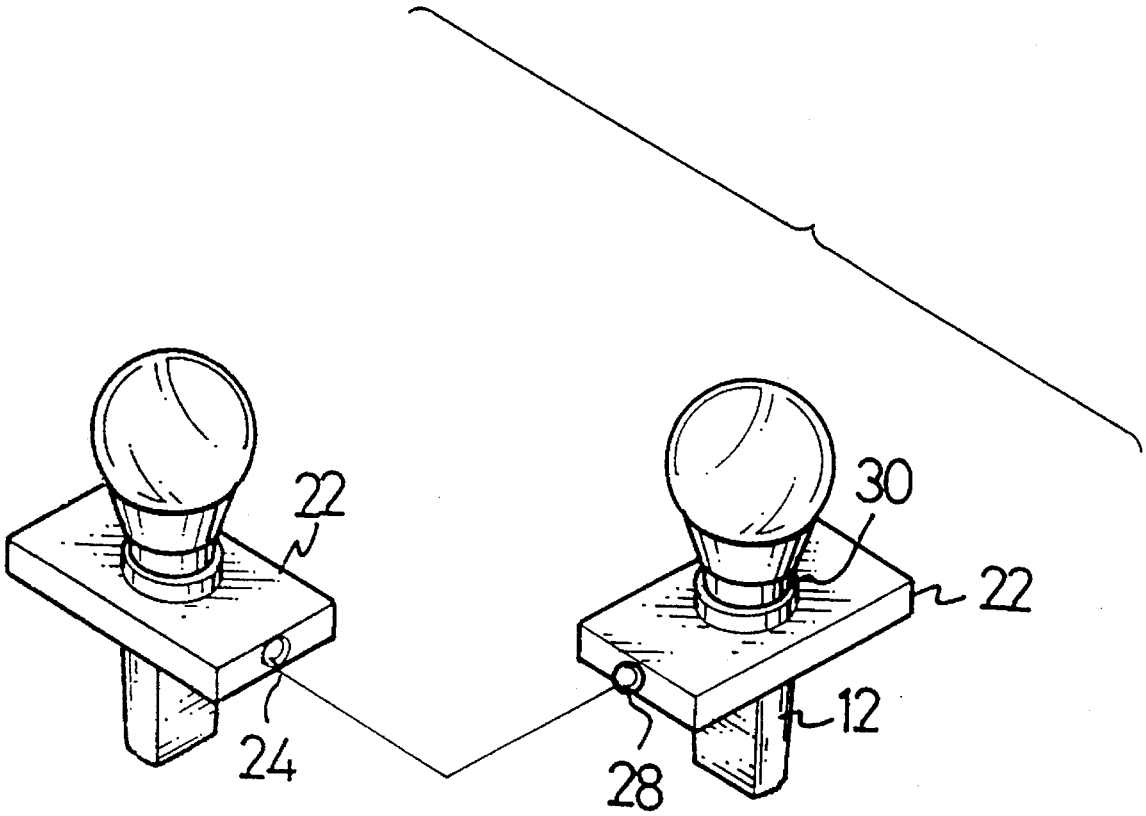
FIG. 8 is an exploded view of a Christmas light string in accordance with a third embodiment of this invention.

FIG. 8 shows a third embodiment of the Christmas light string in accordance with this invention. The Christmas light string includes a chain (not numbered) including a plurality of links 22 (only two are shown for clearness of the figure). Each of the links 22 includes a recess 24 with a spherical form; defined in a first end and a ball 2 of formed on a second end. The ball 28 formed on one link 22 can be pressed into the recess 24 defined in another link 22 in order to join together the links 22. Thus, the chain is rendered a flexible configuration with a rigidity greater than conventional light strings so that it normally retains its shape. The links 22 can be disengaged from one another, if so desired, by pulling the heads 28 from the recesses 24. Each of the links 22 defines a socket-receiving aperture 30 for receiving a socket 12. The bulbs 6 each with a husk 20 and the sockets 12 are conventional. Two conventional wires (not shown) are each wrapped by means of a conventional sheath (not shown). Each of the sheaths includes a plurality of cutouts for exposing a corresponding number of points of each of the wires. The exposed points of the wires are inserted into the sockets 12. The exposed points of the wires function as contacts for engagement with the leads of the bulbs 6 thus electrically connecting the bulbs 6 with one another. The wires are connected with two plugs (not shown) for engagement with a power source (not shown. In fact, the bulbs 6, the sockets 12, the wires and the plugs together make a conventional light string without the above-mentioned chain.

While this invention has been explained in relation to the preferred embodiment thereof, those who are skilled in the art can make variations, which fall within the scope of this invention, from the preferred embodiment which has been described in detail in this specification. The scope of this invention can only be defined by the appended claims.

What is claimed is:

1. In a Christmas light string comprising a chain, said chain including a plurality of interconnected links, the improvement comprising:

each of said links being an elongated planar member having a substantially flat upper surface and a substantially flat lower surface with a predetermined thickness, said member having a generally centrally located socket having a light bulb assembly mounted therein, said light bulb assembly including a light bulb having a husk receivable in a socket, said socket protruding from one side of said member and said bulb protruding from the other side of said member, one of said members having an aperture extending therethrough on opposite sides of said light bulb assembly, another of said members having a protrusion extending from one side of said another of said members on opposite sides of said light bulb assembly mounted on said another of said members, each of said protrusions having an elongated resilient portion extending from said member terminating in an enlarged resilient head greater in outer diameter than the diameter of said apertures, the overall length of said elongated portion being substantially the same as the thickness of said member whereby the heads of each of said protrusions may be press fit into each of said apertures whereby said head extends through said aperture and retains one of said members to another with said members pressed against each other in a frictional relationship and said members can be retained in any desired angle relative to each other by frictional force.

2. In a Christmas light string comprising a chain, said chain including a plurality of interconnected links, the improvement comprising:

each of said links being an elongated planar member having a substantially flat upper surface and a substantially flat lower surface with a predetermined thickness, said member having a generally centrally located socket having a light bulb assembly mounted therein, said light bulb assembly including a light bulb having a husk receivable in a socket, said socket protruding from one side of said member and said bulb protruding from the other side of said member, one of said members having an aperture extending therethrough on one side of said light bulb assembly and having a protrusion extending from the other side of said light bulb assembly, another of said members also having an aperture extending therethrough on one side of said light bulb assembly mounted on said another of said members and a protrusion extending from the other side of said light bulb assembly mounted on said another of said members, each of said protrusions having an elongated resilient portion extending from said member terminating in an enlarged resilient head, greater in outer diameter than the diameter of said apertures, the overall length of said elongated portion being substantially the same as the thickness of said member whereby the heads of each of said protrusions may press fit into each of said apertures whereby said head extends through said aperture and retains one of said members to another with said members pressed against each other in a frictional relationship and said members can be retained in any desired angle relative to each other by frictional force.

* * * * *